United States Patent [19]

Scherenberg et al.

[11] 4,242,991

[45] Jan. 6, 1981

[54] METHOD AND APPARATUS FOR ADJUSTING FUEL SUPPLY TO AN INTERNAL COMBUSTION ENGINE

[75] Inventors: Dieter Scherenberg, Stuttgart; Valerio Bianchi, Hochdorf, both of Fed. Rep. of Germany

[73] Assignee: Robert Bosch GmbH, Stuttgart, Fed. Rep. of Germany

[21] Appl. No.: 916,414

[22] Filed: Jun. 16, 1978

[30] Foreign Application Priority Data

Jun. 21, 1977 [DE] Fed. Rep. of Germany ..... 2727804

[51] Int. Cl.[3] ..... F02B 3/00

[52] U.S. Cl. ..... 123/326; 123/325

[58] Field of Search ..... 123/97 B, 32 EL

[56] References Cited

U.S. PATENT DOCUMENTS

| | | | |
|---|---|---|---|
| 2,868,182 | 1/1959 | Cornelius | 123/97 B |
| 2,993,485 | 7/1961 | Cornelius | 123/97 B |
| 3,690,305 | 9/1972 | Shimada | 123/97 B |
| 3,742,920 | 7/1973 | Black | 123/97 B |

*Primary Examiner*—Ronald B. Cox

*Attorney, Agent, or Firm*—Edwin E. Greigg

[57] ABSTRACT

In order to enrich the fuel mixture fed to an internal combustion engine temporarily subsequent to engine braking, the invention proposes that engine braking is detected as the combination of a closed throttle and elevated engine speed. A detector for this condition supplies a signal to the fuel shut-off mechanism of a valve-control pulse generator. After engine braking, the counter is reset with the signal from the engine braking detector and counts engine-synchronous pulses. The counter contents are decoded and transformed into an analog signal which is used by the pulse generator for additional pulse extension to supply excess fuel to the engine for a limited period of time.

9 Claims, 1 Drawing Figure

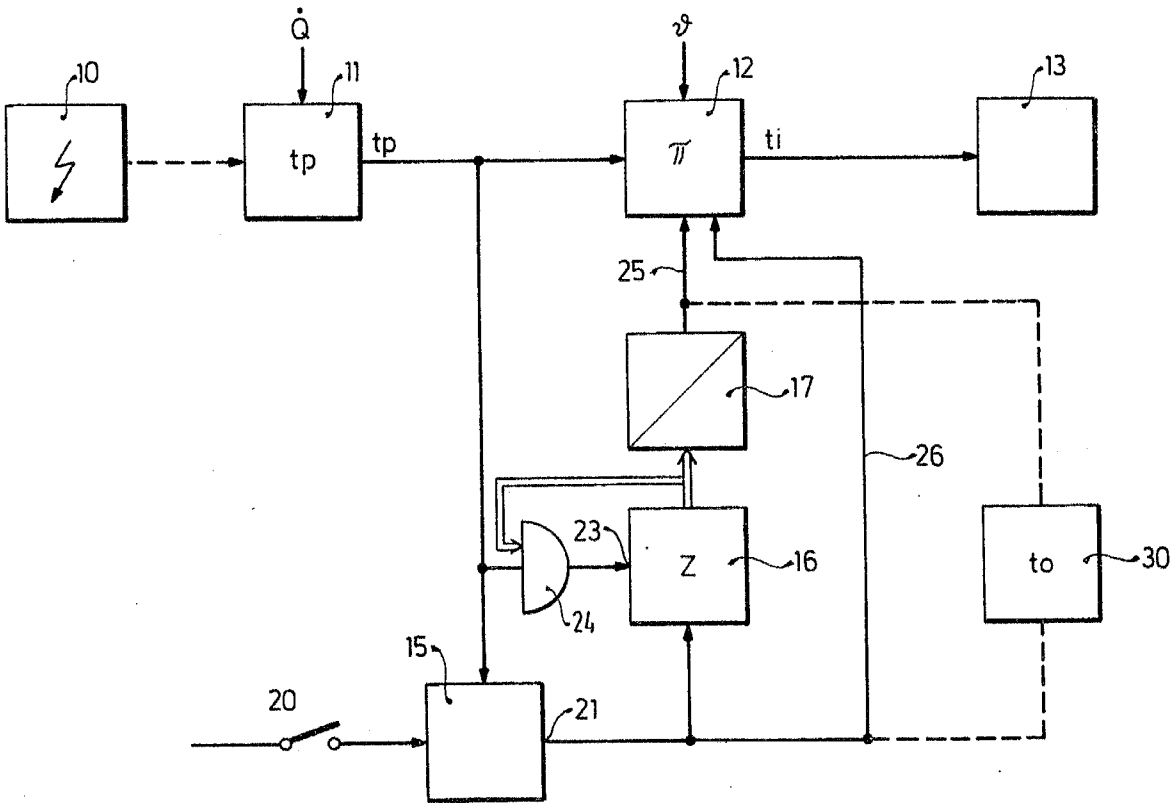
10
11
tp
Q̇
tp
12
ϑ
π
ti
13
25
17
26
16
Z
23
24
21
15
20
30
to

METHOD AND APPARATUS FOR ADJUSTING FUEL SUPPLY TO AN INTERNAL COMBUSTION ENGINE

BACKGROUND OF THE INVENTION

The invention relates to fuel management systems for internal combustion engines. More particularly, the invention relates to a fuel injection system for engines in which there are disposed electromagnetic fuel injection valves that are actuated by control pulses that are generated by a suitable control pulse generator. The frequency and duration of the valve-actuating pulses depend on the engine speed, the inducted air flow rate and other secondary variables such as, for example, engine temperature. Additional engine conditions affecting the valve control pulses may be engine starting, the barometric pressure of the ambient atmosphere and the pulse generator may include a provision for suppressing or sharply reducing the fuel control pulses whenever the vehicle is being operated in downhill use, i.e. when the engine delivers negative torque. This condition is detected as a combination of events, namely that the throttle valve of the engine is closed whereas the engine speed rises above a predetermined minimum. The known fuel injection system and its pulse generator may suppress the valve actuation pulses during engine braking and thus entirely suppress the fuel supplied to the engine. In the known system, when engine braking ends, the system reverts to normal operation, i.e. to the generation of normal control pulses. It may happen however, especially when the engine has been operated in downhill operation or in engine braking for a substantial length of time, that the induction tube is cooled off substantially so that the injected fuel is condensed on the cold interior surfaces of the induction tube and the cylinder walls in which case the resulting mixture will not be optimally combustible and the engine will run rough and tend to generate toxic exhaust gas components, in particular hydrocarbon emissions.

OBJECT AND SUMMARY OF THE INVENTION

It is thus a principal object of the present invention to provide a fuel injection system which includes a mechanism for enriching the fuel-air mixture provided to the engine after the occurrence of engine braking, for example, downhill operation. A related object of the invention is to provide a fuel injection system which causes the engine to operate smoothly and quietly at the end of engine braking, thereby increasing the comfort of the driver and keeping to a minimum any toxic emissions, especially hydrocarbon emissions.

These and other objects are attained according to the present invention by providing a mechanism which senses the condition of engine braking as the occurrence of a closed throttle and a certain minimum engine speed and generates an output signal when this condition is met. This engine braking detector may be part of a known and existing fuel injection system in which the invention constitutes an improvement. The output signal of the engine braking detector is used in normal fashion to diminish or suppress fuel injection during engine braking but it is also used as a provision of the present invention to start a counting process in a digital counter which is originated when engine braking ceases and to use the magnitude of the count to adjust the amount of excess fuel to be supplied to the engine by the control pulse generator after engine braking ceases.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing is a simplified block diagram of a known fuel injection system including the post-engine-braking enrichment mechanism according to the present invention.

DESCRIPTION OF THE PREFERRED EMBODIMENT

Turning now to the FIGURE, there will be seen a pulse generator 10 which generates a train of pulses whose frequency is synchronous with engine speed. These pulses are fed in known manner to a first timing circuit 11 which also accepts air flow rate information indicated schematically by the symbol $\dot{Q}$ and which generates preliminary output pulses $t_p$. These pulses are fed to a known pulse length correcting circuit which may be a pulse width modulator or multiplier of known construction 12 which normally accepts signals related to engine variables, for example, as shown, a temperature signal $\theta$. The pulse width modulator then supplies a corrected output pulse $t_i$ to fuel injection valves 13, possibly via an amplifier stage. In some cases, the known fuel injection system includes an engine braking detector 15 which receives a signal related to throttle valve closure from a switch 20 and also receives the aforementioned preliminary control pulses $t_p$ which are synchronous with engine speed. The engine braking detector 15 uses these two input data to generate an output signal whenever the throttle valve is closed and the engine speed has risen above a predetermined value, thereby indicating engine braking. In order to fulfill the objectives of the present invention, i.e. to increase the amount of fuel after the termination of engine braking, there is further provided a counter 16 which also receives the aforementioned preliminary pulse $t_p$ at a counting input and which has a reset input connected to the output of the engine braking detector 15. The digital content of the counter 16 is fed to the input of a decoder, embodied as a digital-to-analog converter 17 which generates an analog signal whose amplitude is related, e.g. inversely, to the magnitude of the contents of the counter 16. This analog signal is delivered via a line 25 to a correcting input of the control pulse width modulator circuit 12 and is used thereby to increase the length of the control pulses, i.e. to cause an increase of the fuel supplied by the valves 13.

The operation of the apparatus described above is as follows:

The preliminary pulse $t_p$ is generated by the timing circuit 11 on the basis of engine speed and air flow rate $\dot{Q}$. This preliminary pulse $t_p$ is corrected on the basis of engine variables in the pulse width modulator circuit 12 and is fed to the valves 13. Whenever the throttle valve is closed, the switch 20 is also closed and if, at the same time, the engine runs faster than a settable speed, the engine braking detector 15 generates an appropriate signal 21. The engine braking detector 15 may be, for example, a frequency-to-voltage converter coupled to a threshold switch and an AND gate.

The output signal from the detector 15 is used as a direct input via line 26 for the pulse width modulator and causes therein a reduction or complete suppression of fuel control pulses. The same signal is used to reset the counter 16 which thus begins its counting process at the termination of engine braking and which counts the preliminary control pulses $t_p$ at its counting input. When engine braking has terminated and counting begins, the decoder circuit 17 generates an analog signal related inversely to the magnitude of the contents of the counter 16 and this signal is used to temporarily lengthen the valve control pulses $t_p$ in addition to the corrections taking place on the basis of other variables.

The counter 16 must include a provision for preventing a renewed (overflow) count prior to the occurrence of the reset signal. This may be done by arresting the counting process when a particular desired content is reached, for example by introducing a gate 24 at the input 23, with control inputs connected to appropriate output lines of the counter 16.

The above-described improved fuel injection system permits a wide variability of the duration of fuel injection subsequent to the termination of engine braking. This is possible because of the presence of the decoder circuit 17 in combination with the timing circuit or pulse width modulator 12. The duration of the fuel injection control pulses may be increased by a constant amount for a number of pulses which depends on the setting of the gate 24. The pulse width may also be increased for a constant period of time subsequent to the termination of engine braking, for example by the inclusion of an auxiliary timing circuit 30.

It is also possible to increase the length of a certain number of control pulses by an amount depending on counter content.

In the simplest case, the counter 16 may be one or a cascade of bistable flip-flops.

The foregoing relates to a preferred exemplary embodiment of the invention, it being understood that other embodiments and variants thereof are possible within the spirit and scope of the invention.

What is claimed and desired to be secured by Letters Patent of the United States is:

1. An apparatus for supplying fuel to an internal combustion engine, comprising:

fuel injection valves disposed in the intake section of the internal combustion engine;

a pulse generator for generating pulses of variable length, the length depending at least on engine speed and air flow rate; and a counter for counting engine speed-synchronous pulses, said counter having its output connected to an input of said pulse generator for increasing fuel supply for a limited time and being further responsive to a signal initiated subsequent to engine braking.

2. An apparatus as defined by claim 1, further comprising an engine braking detector including a throttle valve position sensor for generating an engine braking signal when the throttle is closed and the engine runs faster than a given speed, said engine braking signal being used to reset said counter and wherein the counting process begins at the termination of engine braking and ends when said counter attains a preset content.

3. An apparatus as defined by claim 1, further comprising an engine braking detector including a throttle valve position sensor for generating an engine braking signal when the throttle is closed and the engine runs faster than a given speed, said engine braking signal being used to reset said counter and wherein the counting process begins at the termination of engine braking and ends upon the expiration of a preset time interval.

4. An apparatus as defined by claim 3, wherein said pulse generator includes a first timing circuit (11) for generating preliminary injection pulses which are fed to a second timing element (pulse modulator) (12) for correcting said preliminary injection pulses and wherein said pulse modulator is connected to receive the output of said counter and said preliminary injection pulses are fed to the counting input of said counter.

5. An apparatus as defined by claim 4, further comprising a decoder circuit connected between the digital output of said counter and the correcting input of said pulse width modulator.

6. An apparatus as defined by claim 5, wherein said decoder circuit generates an analog signal whose magnitude is inversely proportional to the contents of said counter.

7. An apparatus as defined by claim 6, further comprising a gating circuit connected between said pulse generator and the counting input of said counter, said gating circuit having at least one input connected to the output of said counter.

8. An apparatus as defined by claim 4, wherein said decoder circuit (17) includes a diode-resistor network.

9. An apparatus as defined by claim 1, wherein said counter includes at least one bistable flip-flop.

* * * * *